United States Patent [19]

Abbott

[11] 4,179,052

[45] Dec. 18, 1979

[54] CONTAINER CAP

[75] Inventor: Horace P. Abbott, Lake Leelanau, Mich.

[73] Assignee: Lever Brothers Company, New York, N.Y.

[21] Appl. No.: 833,854

[22] Filed: Sep. 16, 1977

[51] Int. Cl.[2] ..... B67D 3/00

[52] U.S. Cl. ..... 222/509; 222/525; 251/340

[58] Field of Search ..... 222/499, 501, 505, 509, 222/522, 525, 531; 251/231, 340

[56] References Cited

U.S. PATENT DOCUMENTS

| | | | |
|---|---|---|---|
| 1,875,821 | 9/1932 | Nazafe | 222/509 |
| 3,227,332 | 1/1966 | Gowdy et al. | 222/525 |

FOREIGN PATENT DOCUMENTS

| | | | |
|---|---|---|---|
| 405013 | 1/1934 | United Kingdom | 222/525 |

*Primary Examiner*—H. Grant Skaggs
*Attorney, Agent, or Firm*—Philip Sands; Melvin H. Kurtz

[57] ABSTRACT

A container cap having, for example, a cylindrical base that is threadedly securable to a container, for example, a plastic bottle, is disclosed. The base has a tubular portion that terminates in an open end to which is affixed a plug member by means of a number of laterally extending ribs. Such ribs support the plug member axially beyond the open end of the tubular portion and leave at least partially open the open end of the tubular portion. A sleeve is secured in surrounding relation to the tubular portion, the sleeve being displaceable axially along the tubular portion between two extreme positions. The sleeve terminates in an open end corresponding cross-sectionally in size and configuration to the plug member, the sleeve having an axial extent such that when it is in one of the extreme positions the open end thereof surrounds the plug member in substantially fluid-sealing relation. A sleeve-displacement device is provided for shifting the sleeve relative to the tubular member to the other of the extreme positions at which the open end of the sleeve is remote from the plug member and entirely open. The sleeve-displacement device is particularly actuable in a direction opposite the direction that the sleeve is displaced to its entirely open position remote from the plug.

8 Claims, 3 Drawing Figures

CONTAINER CAP

BACKGROUND OF THE INVENTION AND STATEMENT OF RELATED PRIOR ART

The present invention relates generally to caps for attachment to containers, such as, for example, pliable plactic bottles and the like. More particularly, the present invention relates to container caps of the "valve-acting" variety in which a top member can be displaced out of its closed position relative to a base member of cylindrical configuration that can be threadedly fastened to a threaded open end of a container.

Such top members of conventional design often have a mushroom-like configuration to facilitate their being grasped by the thumb and forefinger of a user and "pulled" into an open condition so that fluid can be squeezed or pured therethrough from the container.

Examples of conventional mushroom-like cap tops are disclosed in the following U.S. patents:

U.S. Pat. No. 3,439,842 (Apr. 22, 1969)

U.S. Pat. No. 3,227,332 (Jan. 4, 1966)

U.S. Pat. No. 3,201,013 (Aug. 17, 1965)

Examples of related "valve-acting" container caps are disclosed in the following U.S. patents:

U.S. Pat. No. 4,020,981 (May 3, 1977)

U.S. Pat. No. 3,221,952 (Dec. 7, 1965)

It has been determined, however, that such "valve-acting" container caps of the conventional, mushroon-like, variety or otherwise conventional, are not necessarily most desireable. This is because they are of relatively small size and are often difficult to grasp effectively to be "pulled" into an open condition. The present invention, on the other hand, seeks to obviate the need ever to "pull" the "valve-acting" cap top into an open condition or otherwise.

SUMMARY OF THE INVENTION

It is, therefore, an object of the present invention to provide a container cap that can be detachably fastened to the open end of a container, such as, for example, a pliable plastic bottle, the cap having actuation means that can be "pressed" or "pushed" to effect both opening and closing of the container.

The present invention may, therefore, be characterized as a container cap that includes a base means for attachment to an open end portion of a container, the base means including a tubular portion that terminates in an open end, a plug member, support means for fixedly securing the plug member to and axially beyond the open end of the tubular portion, the support means extending across and leaving at least partially open the open end of the tubular portion, and a sleeve secured in surrounding relation to the tubular member, the sleeve being displaceable axially along the tubular portion between two extreme portions.

The sleeve terminates in an open end corresponding cross-sectionally in size and configuration to the plug member, the sleeve having an axial extent such that when it is in one of the extreme positions the open end thereof surrounds the plug member substantially in fluid-sealing relation. The sleeve includes sleeve-displacement means for facilitating shifting of the sleeve relative to the tubular member to the other of the extreme positions, the sleeve when in said other of the extreme positions having a disposition such that the open end thereof is remote from the plug member and entirely open. The sleeve-displacement means is unidirectionally actuable in a direction opposite the direction that the sleeve is displaced to its entirely open position remote from the plug member.

Particularly, the sleeve-displacement means includes fulcrum means fixedly secured to the base means, lever means, and hinge means for securing the lever means flexibly to the sleeve. The lever means is engageable with the fulcrum means and has a free-end portion that is accessible for manipulation and depression.

BRIEF DESCRIPTION OF THE DRAWINGS

With the above and additional objects and advantages in view as will hereinafter appear, the present invention comprises the devices, combinations and arrangements of parts hereinafter described and illustrated in the accompanying drawings of a preferred embodiment, in which.

DETAILED DESCRIPTION OF THE INVENTION

Figure 1:
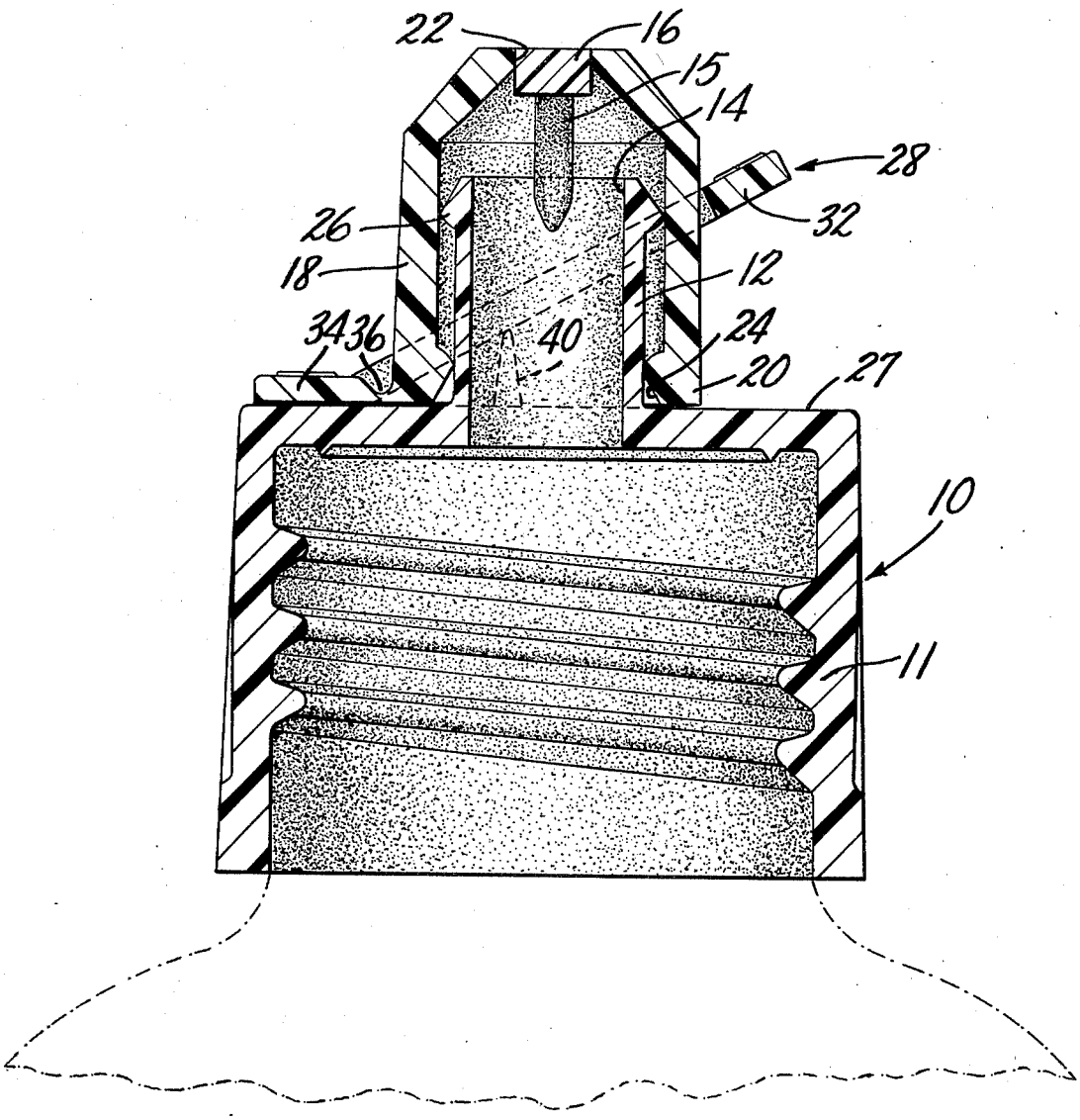
FIG. 1 is a cross-sectional view, in elevation, taken along the line 1—1 in FIG. 2, of the container cap of the present invention.

Referring now to the drawings, the present invention relates to a container cap generally designated by the reference character 10. The container cap 10 includes an internally thereaded, base member 11 that can be threadedly fastened, in a conventional manner, to the externally threaded mouth of, for example, a conventional pliable, plastic bottle (not shown). The upper portion of the base member 11 includes a tubular member 12 of reduced diameter having an upper open end 14. The open end 14 includes a pluality of (for example, three) spaced ribs 15 which in cantilevered, frusto-conical, fashion are secured to the tubular member 12 and function to support an axially upstanding plug 16. The ribs 15, for example, are spaced 120° apart from one another and are joined (in a conventional manner, shown in phantom in FIG. 2) at the center of the tubular member 12. In particular, the plug 16 at one end is affixed to the juncture of the ribs 15 and at its opposite end projects free and stabilized remote from the open end 14 of the tubular member 12.

Associated with, and axially displaceable relative to, the tubular member 12, is a sleeve 18. The sleeve 18, as illustrated in FIG. 1, at its lower end 20, is engageable with the base member 11, and in this position locates an opening 22 formed in its upper portion in surrounding relation about the plug 16. In this position, the plug 16, in substantially fluid-sealing relation, closed the opening 22 of the sleeve 18.

The sleeve 18, furthermore, at its lower portion 20 includes an internal annular ledge 24 that is axially engageable with an external annular ledge 26 formed at the upper portion of the tubular member 12. It is the engagement of the annular ledges 24 and 26 that limits the axial displacement of the sleeve 18 to one of two extreme positions. The other extreme position that the sleeve 18 has with respect to the tubular member 12 is that position of the sleeve 18 illustrated in FIG. 1 in which the lower portion 20 of the sleeve engages the upper shoulder 27 of the base member 11.

Figure 3:
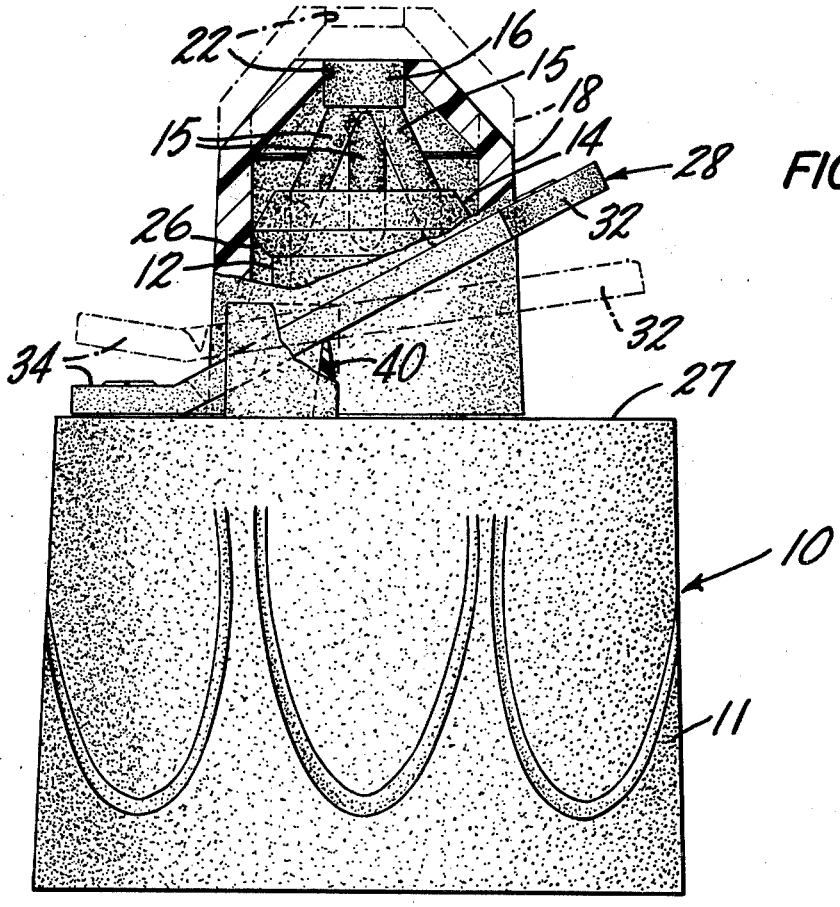
FIG. 3 is an elevational, partly fragmentary, partly cros-sectional view of the container cap of the present invention.
Figure 2:
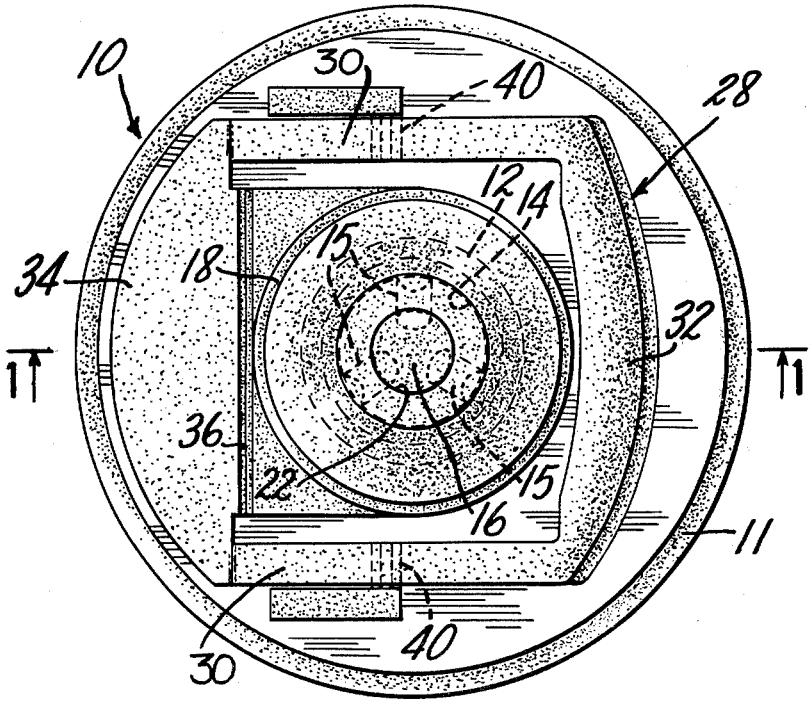
FIG. 2 is a plan view of the container cap illustrated in FIG. 1.

The sleeve 18 includes a sleeve-displacement means which in part includes a lever 28. As best illustrated in FIG. 2, the lever 28 is bifurcated and, thus, includes a pair of arms 30, one on either side of the sleeve 18. The arms 30 are interconnected at one end by a hand-operable first actuation element 32 and at their opposite end by a hand-operable second actuation element 34. The actuation elements 32 and 34 act to fixedly bridge the arms 30 of the lever 28 and, though not necessarily, extend in substantially perpendicular relation to the latter. As best illustrated in FIGS. 1 and 3, the actuation element 32 is initially in an upper position remote from the base member 11. On the other hand, the actuation element 34 is initially in a position engaging, or near-engaging, a shoulder 27 of the base member 11.

Referring again to FIG. 2, the actuation element 34 is connected to the sleeve 18 via a scored, flexible hinge 36. In this regard, the lever 28 and sleeve 18 are preferably, though not necessarily, molded as a single piece with the scored flexible hinge 36 therebetween. The lever 28 is adapted to pivot about a pair of aligned fulcrums 40 (FIG. 2) as the lever 28 is displaced clockwise from the position shown is solid line in FIG. 3 to successive positions shown in phantom in FIG. 3. Particularly, each of the arms 30 of the lever 28 is associated with a respective one of the fulcrums 40, which fulcrums 40 are formed as part of the base member 11 and project in upstanding relation from the shoulder 27 of the base member 11. For reference purposes herein, the lever 28, the hinge 36 and the fulcrums 40 constitute the aforementioned "sleeve-displacement means."

Preferably, the fulcrums 40 are all offset relative to the concentric centers of the tubular member 12 and sleeve 18 in a manner as best illustrated in FIG. 2. Also, the actuation element 34, in cross-section, is inclined relative to the arms 30, whereas the actuation element 32 is substantially coplaner with the arms 30. As a result, as illustrated in FIGS. 1 and 3, the actuation element 34 is adapted to engage the shoulder 27 of the base member 11 when the sleeve 18 is in the one extreme position thereof at which the open end 22 surrounds the plug 16 is substantially fluid-sealing relation. In such condition, or position, of the actuation element 34, the actuation element 32 is remote from the shoulder 27 of the base member 11. Thus, the lever 28, via the actuation element 32, is in a condition for actuation to facilitate shifting of the sleeve 18 axially upwardly relative to the tubular member 12 to effect opening of the cap 10.

In operation of the present invention, the actuation element 32 can be depressed downwardly toward the shoulder 27 of the base member 11, thereby causing the actuation element 34 to lift upwardly as the arms 30 pivot about the aligned fulcrums 40. As the actuation element 34 elevates, the hinge 36 flexes to permit the actuation element 34 to bend relative to the remainder of the sleeve 18. As a result, the sleeve 18 elevates causing the opening 22 therein to move remote from the plug 16 into a fully open condition.

Thereafter, closing of the cap 10 of the present invention is effected simply by depressing the actuation element 34, thereby causing the actuation element 32 to elevate to its initial position and the sleeve 18 to descend into engagement, or near-engagement, with the shoulder 27 of the base member 11. Once such engagement is achieved, the plug 16 projects into the opening 22 and closes it.

Having thus set forth the nature of the present invention, it will be understood that the foregoing description of the preferred embodiment is for purposes of illustration only, and that the various structural and operational features and relationships herein disclosed are susceptible to a number of modifications and changes none of which entails any departure from the spirit and scope of the present invention as defined in the hereto appended claim.

What is claimed is:

1. In a container cap including base means for attachment to an open end portion of a container, said base means including a tubular portion terminating in an open end, a plug member, support means for fixedly securing said plug member to and axially beyond said open end of said tubular portion, said support means extending over and leaving at least partially open said open end of said tubular portion, and a sleeve constrained in surrounding relation on said tubular portion, said sleeve being displaceable axially along said tubular portion between two extreme positions, said sleeve terminating in an open end corresponding cross-sectionally in size and configuration to said plug member, said sleeve having an axial extent such that when it is in one of said extreme positions said open end thereof surrounds said plug member substantially in fluid-sealing relation, an improvement comprising sleeve-displacement means for shifting said sleeve relative to said tubular member to the other of said extreme positions, said sleeve when in said other of said extreme positions having a disposition such that said open end thereof is remote from said plug member and entirely open, said sleeve-displacement means including a hand-operable first actuation element which is uni-directionally actuable in a direction opposite the direction said sleeve is displaced to said other of said extreme positions at which said open end of said sleeve is remote from said plug member, and a hand-operable second actuation element which is uni-directionally actuable in a direction which is the same as the direction said sleeve is displaced to said one of said extreme positions at which said open end of said sleeve surrounds said plug member in substantially fluid-sealing relation.

2. An improvement as claimed in claim 1, wherein said sleeve-displacement means includes fulcrum means fixedly secured to said base means, lever means, and hinge means for securing said lever means flexibly to said sleeve, said lever means being engageable with said fulcrum means and having a free-end portion accessible for manipulation.

3. An improvement as claimed in claim 2, wherein said fulcrum means includes a pair of aligned lugs fixedly spaced on either side of said sleeve to said base means and projecting generally outwardly toward said open end of said tubular portion, said lever means including a pair of arms spaced on either side of said sleeve, said actuation elements being spaced on either side of said sleeve perpendicular to said arms and fixedly bridging the opposite ends of each of said arms with one another, said hinge means including flexible transition means running lengthwise with and interconnecting one of said actuation elements to a portion of said sleeve between said arms.

4. An improvement as claimed in claim 3, wherein said actuation element associated with said flexible transition means in cross-section is inclined relative to each of said arms, the other of said actuation elements being substantially coplanar with said arms.

5. An improvement as claimed in claim 4, wherein said actuation element associated with said flexible transition means is adapted to engage said base means when said sleeve is in said one extreme position at which said open end of said sleeve surrounds said plug member substantially in fluid-sealing relation.

6. An improvement is claimed in claim 5, wherein said other of said actuation elements is remote from said base means when said actuation element associated with said flexible transition means is in at least near-engagement with said base means.

7. An improvement as claimed in claim 6, wherein said fulcrum lugs in alignment with one another are offset relative to the center of said tubular portion of said base means.

8. An improvement as claimed in claim 6, wherein said flexible transition means interconnects said actuation element associated therewith to said sleeve at an end portion of said sleeve most remote from said open end of said sleeve that is associated with said plug member.

* * * * *